United States Patent [19]

Newton, Jr. et al.

[11] Patent Number: 4,844,185

[45] Date of Patent: Jul. 4, 1989

[54] ROTARY DRILL BITS

[75] Inventors: Thomas A. Newton, Jr., Houston, Tex.; Michael C. Regan, Robinswood, England

[73] Assignee: Reed Tool Company Limited, Northern Ireland

[21] Appl. No.: 119,145

[22] Filed: Nov. 10, 1987

[30] Foreign Application Priority Data

Nov. 11, 1986 [GB] United Kingdom ..... 8626919

[51] Int. Cl.[4] ..... E21B 10/46

[52] U.S. Cl. ..... 175/329; 76/108 A; 175/410

[58] Field of Search ..... 175/327, 329, 409, 410, 175/411; 76/108 A

[56] References Cited

U.S. PATENT DOCUMENTS

| | | | |
|---|---|---|---|
| 4,098,363 | 7/1978 | Rohde et al. | 175/329 |
| 4,244,432 | 1/1981 | Rowley et al. | 175/329 |
| 4,359,112 | 11/1982 | Garner et al. | 175/410 X |
| 4,570,726 | 2/1986 | Hall | 175/329 X |
| 4,726,718 | 2/1988 | Meskin et al. | 175/329 X |

FOREIGN PATENT DOCUMENTS

| | | | |
|---|---|---|---|
| 2504589 | 10/1982 | France | 175/329 |
| 2161849 | 1/1986 | United Kingdom | 175/329 |

*Primary Examiner*—Jerome W. Massie
*Assistant Examiner*—David J. Bagnell
*Attorney, Agent, or Firm*—Browning, Bushman, Zamecki & Anderson

[57] ABSTRACT

A rotary drill bit for use in drilling or coring deep holes in subsurface formations comprises a bit body having a leading face and a gauge region, cutting elements mounted at the leading face of the bit body, and a passage in the bit body communicating with nozzles in the leading face of the bit body for supplying drilling fluid to the face for cooling and cleaning the cutting elements. Certain of the cutting elements each comprise a preform cutting element having a superhard front cutting face providing a cutting edge, and others of the cutting elements each comprise particles of hard material embedded in a front layer of a less hard material to form a cutting layer having a cutting edge. The distribution of the cutting elements over the leading face of the bit is such that the proportion of the combined length of cutting edges provided by preform cutting elements to the combined length of cutting edges provided by embedded-particle cutting elements generally increases with distance from the central axis of rotation of the bit.

17 Claims, 2 Drawing Sheets

ROTARY DRILL BITS

BACKGROUND OF THE INVENTION

The invention relates to rotary drill bits for use in drilling or coring deep holes in subsurface formations and of the kind comprising a bit body having a leading face and a gauge region, a plurality of cutting elements mounted at the leading face of the bit body, and a passage in the bit body communicating with openings in the leading face of the bit body for supplying drilling fluid to said face for cooling and cleaning the cutting elements.

There are many different designs of drill bit of this general type. For example, the bit body may be machined from solid metal, usually steel, or may be moulded using a powder metallurgy process in which tungsten carbide powder is infiltrated with metal alloy binder in a furnace so as to form a hard matrix. The cutting elements may be mounted directly on the bit body, or may be mounted on carriers, such as studs or posts, which are received in sockets in the bit body.

One common form of cutting element is a preform cutting element having a superhard front cutting face. For example, the cutting element may comprise a hard facing layer of polycrystalline diamond bonded to a backing layer of less hard material, such as cemented tungsten carbide. Since the backing layer is of less hard material than the facing layer, the two-layer arrangement of the cutting element provides a degree of self-sharpening since, in use, the less hard backing layer wears away more easily than the harder cutting layer.

Such preform cutting elements are often in the form of a circular tablet of substantially constant thickness or are derived from such tablets. For example, the elements may be sectors or segments of such circular tablet. Other polycrystalline diamond preforms comprise a unitary body or layer of polycrystalline diamond formed without a backing layer, and such elements may be thermally stable so that they may, for example, be incorporated in a matrix body bit during formation of the matrix.

In order that the entire surface of the bottom of the hole being drilled is acted on by the cutting elements, the elements are located at different distances from the central axis of rotation of the drill bit. However, cutting elements further from the axis of rotation, and nearer the gauge region, move more rapidly relative to the formation than elements nearer the axis of rotation and the annular area of formation swept by each such cutting element is greater. As a result, cutting elements nearer the gauge region tend to wear more rapidly than elements near the axis of rotation. In order to combat this it is often the practice to position more cutting elements nearer the gauge region. Where preform cutting elements are used it is usual for such cutting elements to be used all over the leading face of the bit, although bits have been manufactured where the preform cutting elements are supplemented by natural diamonds embedded in the leading face of the bit, particularly in the region around the axis of rotation where it may be difficult to fit sufficient preform cutting elements due to limitations of space. The disadvantage of such arrangement is that natural diamonds are not self-sharpening so that, as the drill bit wears in prolonged use, the diamonds may become less effective than the preform cutting elements in certain types of formation.

A drill bit having preform cutting elements over substantially the whole of the leading face is expensive to manufacture due to the comparatively high cost of the preform cutting elements themselves. The present invention is based on the realisation that, since cutting elements nearer the axis of rotation are less subject to wear than cutting elements further from the axis, as described above, such cutting elements may be replaced by a form of cutting element which is cheaper to manufacture than preform cutting elements, provided the cheaper elements still provide a degree of self-sharpening and also provide sufficient wear resistance for their location on the drill bit.

SUMMARY OF THE INVENTION

According to the invention, therefore, there is provided a rotary drill bit for use in drilling or coring deep holes in subsurface formations, comprising a bit body having a leading face and a gauge region, a plurality of cutting elements mounted at the leading face of the bit body, and a passage in the bit body communicating with openings in the leading face of the bit body for supplying drilling fluid to said face for cooling and cleaning the cutting elements, certain of said cutting elements each comprising a preform cutting element having a superhard front cutting face providing a cutting edge and others of said cutting elements each comprising particles of hard material embedded in a front layer of a less hard material to form thereon a cutting layer having a cutting edge, the distribution of the cutting elements over the leading face of the bit being such that the proportion of the combined length of cutting edges provided by preform cutting elements to the combined length of cutting edges provided by embedded-particle cutting elements generally increases with distance from the central axis of rotation of the bit.

The cutting elements may each provide substantially the same cutting edge length, in which case the number of preform cutting elements increases in proportion to the number of embedded-particle cutting elements with distance from the central axis of the bit.

The hard particles in each embedded-particle cutting element may also be formed of superhard material. As is well understood in the art, "superhard" materials are materials such as natural diamond, synthetic diamond and cubic boron nitride.

By the "cutting edge length" of a cutting element is meant that length of the cutting edge which is available to act on the formation. When a drill bit is new and unworn only a part of the available cutting edge of each cutting element may act initially on the formation, a greater length of each cutting edge coming into play as the cutters wear.

Embedded-particle cutting elements of the kind described are generally cheaper to manufacture than preform cutting elements since they do not require the extremely high pressure and high temperature presses in which preform cutting elements are manufactured. Such cutting elements tend to be less wear resistant than preform cutting elements but according to the invention they are used predominantly in areas of the leading face of the bit where they are subjected to less wear. Since the particles of hard material are embedded in the body of less hard material to form a front layer, these cutting elements, like the preform cutting elements, also provide a degree of self-sharpening since the less hard material behind the front layer will wear away more rapidly than the front cutting layer.

An area of the leading face of the bit around the central axis of rotation thereof may be provided substantially entirely with embedded-particle cutting elements. In other words, the proportion of the combined cutting edge length provided by such cutting elements in that inner area may be 100%. Similarly, an area of the leading face of the bit around the periphery thereof may have the combined cutting edge length provided substantially entirely by the preform cutting elements. The area where the combined cutting edge length is provided substantially entirely by embedded-particle cutting elements may, for example, extend across about three-quarters of the radius of the leading face of the bit body.

In the case where the embedded particles comprise superhard material the material in which they are embedded may comprise cemented tungsten carbide or matrix material similar to that from which the bit body may be formed. Alternatively, the embedded particles may comprise tungsten carbide in which case the less hard material in which they are embedded may comprises steel.

The body of material, with the particles of hard material embedded in a front layer thereof, may be separately formed from the bit body, being mounted on the bit body after or during manufacture thereof. Alternatively, the body of material, or part thereof, in which the particles are embedded may comprise an integral part of the bit body, being incorporated in the bit body during the manufacture thereof. For example, in the case where the bit body is formed by a powder metallurgy process, the body of material in which the hard particles are embedded to form each cutting element, or a part of such body, may comprise a portion of the bit body having the necessary characteristics of hardness and wear resistance to form part of the cutting element.

In the case where the embedded-particle cutting elements are separately formed from the bit body, the bit body may be machined from metal, such as steel. Alternatively the bit body may be formed from solid infiltrated matrix material using a powder metallurgy process.

Each of the aforesaid preform cutting elements may comprise a thin facing layer of superhard material bonded to a less hard backing layer. For example, the superhard material may comprise polycrystalline diamond material. Alternatively, each preform cutting element may comprise a unitary layer of thermally stable polycrystalline diamond material.

Each preform cutting element may be directly mounted on the bit body or may be mounted on a carrier received in a socket in the bit body. In the case where the cutting element is a unitary layer of thermally stable polycrystalline diamond material, the desirable self-sharpening effect is provided by the carrier or bit body being of less hard material than the cutting element.

The surface of the bit body may be provided with a plurality of blades extending outwardly with respect to the axis of rotation of the drill bit, said cutting elements being mounted along the lengths of the blades.

The invention includes within its scope a cutting element for a rotary drill bit comprising a front cutting layer of hard material having particles of superhard material embedded therein and a backing layer of less hard material.

The superhard material, which as previously mentioned may comprise, natural or synthetic diamond or cubic boron nitride, may be embedded in the front portion of a unitary body of material. Alternatively, the front layer containing the embedded particles of superhard material may be separately formed from the backing layer, being subsequently bonded thereto.

DETAILED DESCRIPTION OF THE PREFERRED EMBODIMENTS

Figure 1:
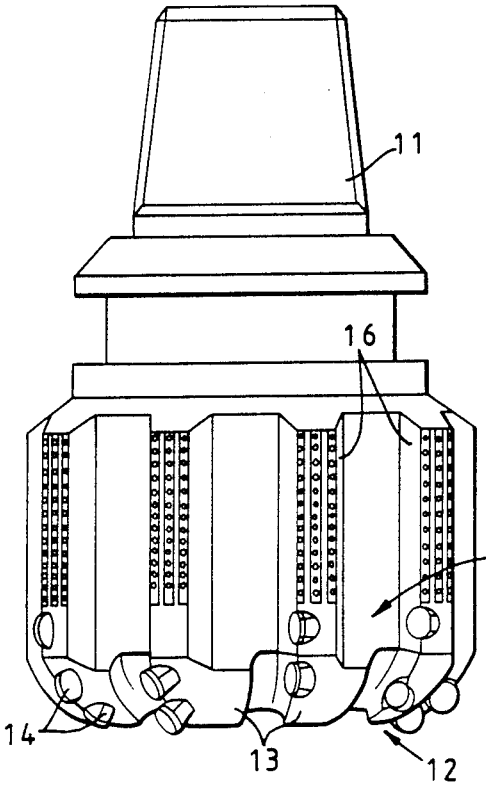
FIG. 1 is a side elevation of a typical drill bit of the kind to which the invention is applicable.
Figure 2:
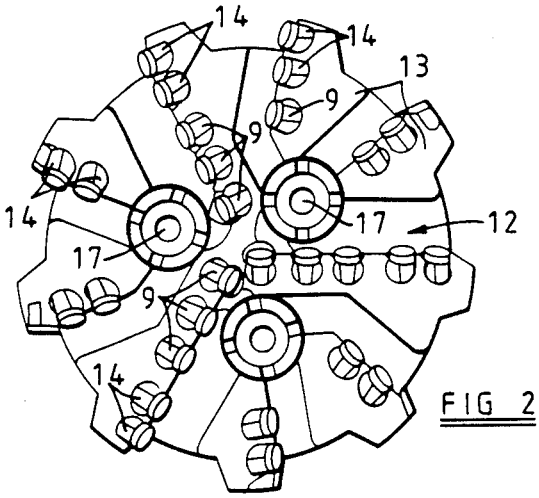
FIG. 2 is an end elevation of the drill bit shown in FIG. 1.

Referring to FIGS. 1 and 2, these show a full bore drill bit of a kind to which the present invention is applicable. The bit body 10 is typically formed of carbide matrix infiltrated with a binder alloy, and has a threaded shank 11 at one end for connection to the drill string. The leading face 12 of the bit body is formed with a number of blades 13 radiating from the central area of the bit and the blades carry cutting structures 14 and 9 spaced apart along the length thereof.

The bit gauge section 15 includes kickers 16 which contact the walls of the bore hole to stabilize the bit in the bore hole. A central passage (not shown) in the bit body and shank delivers drilling fluid through nozzle 17 in the leading face 12 in known manner.

It will be appreciated that this is only one example of the many possible variations of the type of bit to which the invention is applicable, including bits where the body is machined from steel.

In accordance with the invention the cutting structures are of two basic types. They either comprise preform cutting elements 14 having a superhard front cutting face or embedded-particle cutting elements 9 where particles of hard material, and preferably superhard material, are embedded in a front layer of a less hard material to form a front cutting layer. Examples of the cutting structures are shown in FIGS. 3, 4 and 5.

Figure 3:
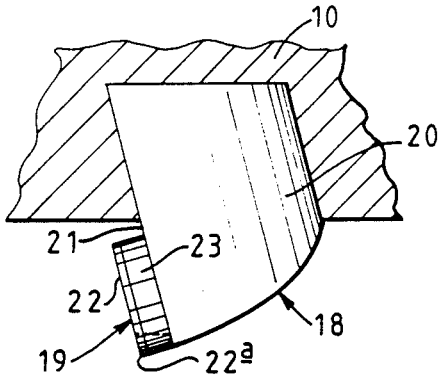
FIG. 3 is a diagrammatic section through a typical cutting structure incorporating a preform cutting element.

Referring to FIG. 3, the cutting structure 14 comprises a preform cutting element 19 mounted on a carrier 20 in the form of a stud which is located in a socket 21 in the bit body 10. The preform cutting element 19 is circular and comprises a thin facing layer 22 of polycrystalline diamond bonded to a backing layer 23, for example of tungsten carbide. The facing layer 22 provides a cutting edge indicated at **22*a*. The rear surface of the backing layer 23 is bonded, for example by brazing, to a suitably orientated surface on the stud 20** which may also be formed from tungsten carbide.

Figure 4:
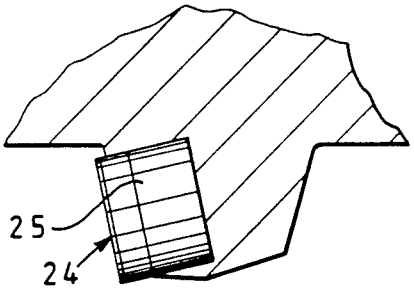
FIG. 4 is a similar view to FIG. 3 of an alternative cutting structure incorporating a preform cutting element.
Figure 5:
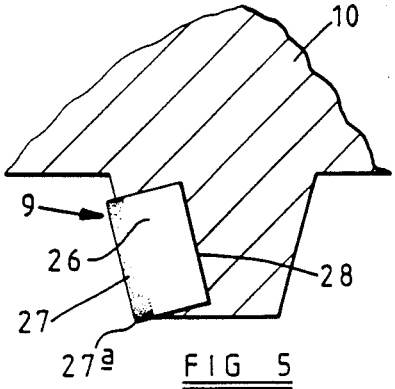
FIGS. 5–8 are similar views to FIG. 4 showing embedded-particle cutting elements.

In the alternative arrangement shown in Figure 4, the circular cross-section cutting element 24 is bonded to the end face of a cylindrical stud 25 which is coaxial with the cutting element 24.

In either of the arrangements described the stud may be brazed into the socket or may be interference-fitted.

As is well known, two-layer preform cutting elements of the kind indicated at 19 and 24 provide a degree of self-sharpening since the less hard backing layers wears away more easily than the superhard front cutting layer. In the case of circular preforms, as shown, the cutting edge length available to act on the formation be may considered to comprise the semi-circular edge which extends around the lower half of each preform.

Other types of preform cutting element include a unitary layer of thermally stable polycrystalline diamond material suitably mounted on a carrier or mounted directly on the bit body.

Referring to FIG. 5: in this case the cutting structure 9 comprises a cutting element in the form of a cylindrical body 26 of tungsten carbide, the front layer of which has embedded therein particles of natural diamond, or other superhard material, as indicated at 27, and providing a cutting edge *27a*. The body of material 26 is brazed or otherwise secured in a socket 28 in the bit body 10.

In an alternative arrangement, shown in FIG. 6, instead of the diamond layer 27 being integrally incorporated into the main body of material 26, the diamond impregnated layer is formed as a separate disc 29 of material which is subsequently bonded to the front of a separately formed carrier 30, for example of tungsten carbide.

Since the diamond particles are embedded in only the front layer of the body, this type of cutter also exhibits a self-sharpening effect since the material rearwardly of the embedded layer wears away more easily than the layer itself.

Figure 6:
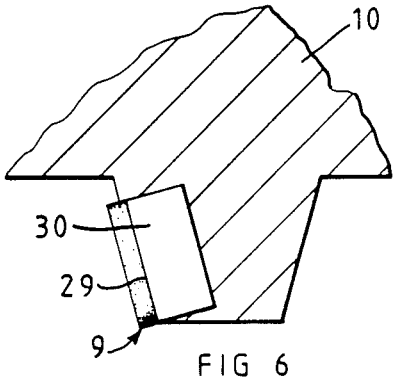

In the arrangements of FIGS. 5 and 6 the embedded diamond layer may be of the order of 1 to 3 mm in thickness in the case where the cutting element is of conventional diameter, for example 13.3 mm. If required, the embedded-particle cutting element may also be mounted on a carrier, for example a stud as shown in FIG. 3 or a coaxial cylindrical carrier as shown in FIG. 4.

In one commonly used method of making rotary drill bits, the bit body is formed by a powder metallurgy process and in this case the embedded-particle cutting element may be partly formed during the manufacture of the bit instead of being a separately formed element as shown in FIGS. 5 and 6.

In the formation of a bit body by a powder metallurgy process, a hollow mould is first formed, for example from graphite, in the configuration of the bit body or a part thereof. The mould is packed with powdered material, such as tungsten carbide, which is then infiltrated with a metal alloy binder, such as a copper alloy, in a furnace so as to form a hard matrix.

The separately formed embedded-particle cutting element of the kind shown in FIG. 5 may, in this case, be embodied in the bit body by locating such elements on the interior surface of the mould before it is packed with tungsten carbide, so that the elements become embedded in the matrix during the formation of the bit body. Alternatively, there may be located in the mould elements corresponding only to the front layer of the cutting element in which diamond particles are embedded. The rear portion of the cutting element is then provided by packing in the mould on the rearward side of the embedded layer a body of material which, in the formation of the bit body, is formed into a backing layer of suitable hardness. For example, there may be applied to the rearward side of each embedded layer in the mould a compound known as "wet mix" comprising tungsten carbide powder mixed with polyethylene glycol. Once the mould has been further packed with conventional matrix material it is heated in a furnace to burn off the polyethylene glycol whereafter the material is infiltrated with the copper alloy binder or other infiltrant. The wet mix applied behind each diamond embedded layer is selected to provide the necessary characteristics, e.g. skeletal density, modulus of elasticity, hardness and abrasion resistance, to provide the necessary backing for the embedded diamond layer. The characteristics of the wet mix applied behind each embedded diamond layer will normally be such as to produce material having greater hardness and wear resistance than the material of the main body of the matrix. A cutting element according to this method is shown in FIG. 7, where the embedded cutting layer is indicated at 31 and the backing material is indicated at 32.

Figure 7:
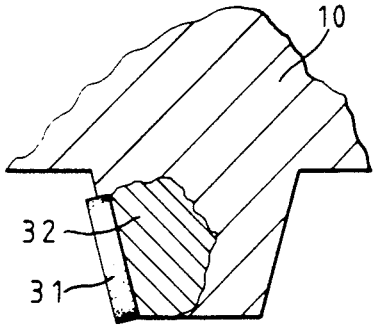
Figure 8:
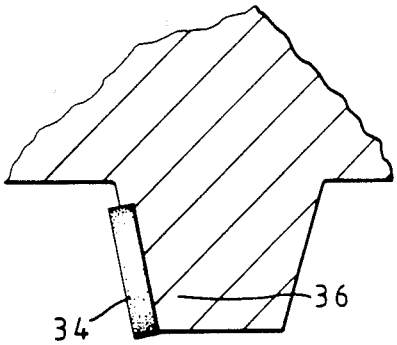

In other embodiments, as shown in FIG. 8, a disc 34 with superhard particles embedded therein can be similarly mounted in a matrix bit body during formation of the latter, but without the use of a wet mix to provide a harder portion of the bit body (as at 32 of FIG. 7). The matrix material 36 itself then serves as a less hard backing layer for the embedded cutting layer 34.

In still other embodiments, it may even be possible to embed the superhard particles directly in the matrix material to form the cutting layer.

Preform cutting elements of the kind shown in FIGS. 3 and 4 are comparatively expensive to manufacture due to the necessity of using extremely high temperature and pressure presses. Embedded-particle cutting elements of the kind shown in FIGS. 5, 6 7 or 8, or otherwise as described, on the other hand, may be more easily and cheaply manufactured.

In accordance with the invention the distribution of preform and embedded-particle cutting elements over the surface of the leading face of the drill bit, for example of the kind shown in FIGS. 1 and 2, is such that the proportion of the combined length of cutting edges provided by preform cutting elements 14 to the combined cutting edge length provided by embedded-particle cutting elements 9 generally increases with distance from the central axis of rotation of the bit. Thus, where each cutting element is of similar shape and size and thus provides substantially the same cutting edge length, more preform cutting elements are provided in the areas which are subjected to the greatest wear. For example, embedded-particle cutters 9 may be employed in substantially the whole central area of the leading face of the bit up to three quarters of the radius of the bit. In this case preform cutters 14 are used in the outermost quarter of the radius of the bit. However, other distributions may be employed and the invention includes within its scope arrangements where some preform cutters are included in the central areas and/or some embedded-particle cutters are included in the outer areas.

Although, as previously described, the embedded particles 27 of FIG. 5 may comprise superhard particles embedded in tungsten carbide, in some cases it may be suitable for the particles 27 to comprise some other form of hard material, such as tungsten carbide, in which case the body 26 of less hard material may comprise steel.

We claim:

1. A rotary drill bit for use in drilling or coring holes in subsurface formations, comprising a bit body having a leading face and a gauge region, a plurality of cutting elements mounted at the leading face of the bit body, and a passage in the bit body communicating with openings in the leading face of the bit body for supplying drilling fluid to said face for cooling and cleaning the cutting elements, certain of said cutting elements each comprising a preform cutting element having a superhard front cutting face providing a cutting edge and others of said cutting elements each comprising a separately preformed element of hard material having a plurality of particles of harder material embedded in at least a front layer thereof to form thereon a cutting layer having a cutting edge, the distribution of the cutting elements over the leading face of the bit being such that the proportion of the combined length of cutting edges provided by preform cutting elements having a superhard front cutting face to the combined length of cutting edges increases with distance from the central axis of rotation of the bit.

2. A drill bit according to claim 1, wherein the cutting elements each provide substantially the same cutting edge length and the number to preform cutting elements increases in proportion to the number of embedded-particle cutting elements with distance from the central axis of the bit.

3. A drill bit according to claim 1, wherein the hard particles in each embedded-particle cutting element are also formed of superhard material selected from natural diamond, synthetic diamond and cubic boron nitride.

4. A drill bit according to claim 1, wherein an area of the leading face of the bit around the central axis of rotation thereof is provided substantially entirely with embedded-particle cutting elements, whereby the proportion of the combined cutting edge length provided by such cutting elements in that inner area is 100%.

5. A drill bit according to claim 4, wherein the area where the combined cutting edge length is provided substantially entirely by embedded-particle cutting elements extends across substantially three-quarters of the radius of the leading face of the bit body.

6. A drill bit according to claim 1, wherein an area of the leading face of the bit around the periphery thereof has the combined cutting edge length provided substantially entirely by the preform cutting elements having a superhard front cutting face.

7. A drill bit according to claim 1, wherein the embedded particles comprises superhard material and the material in which they are embedded comprises cemented tungsten carbide.

8. A drill bit according to claim 1, wherein the embedded particles comprise tungsten carbide and the less hard material in which they are embedded comprises steel.

9. A drill bit according to claim 1, wherein the body of material, with the particles of hard material embedded in a front layer thereof, is separately formed from the bit body before being mounted on the bit body.

10. A drill bit according to claim 1, wherein at least part of the body of material in which the particles are embedded comprises an integral part of the bit body, being incorporated in the bit body during the manufacture thereof.

11. A drill bit according to claim 1, wherein the embedded-particle cutting elements are separately formed from the bit body and the bit body is machined from metal.

12. A drill bit according to claim 1, wherein the embedded-particle cutting elements are separately formed from the bit body and the bit body is formed from solid infiltrated matrix material using a powder metallurgy process.

13. A drill bit according to claim 1, wherein each of the aforesaid preform cutting elements having a superhard front cutting face comprises a thin facing layer of superhard material bonded to a less hard backing layer.

14. A drill bit according to claim 13, wherein the superhard material is polycrystalline diamond.

15. A drill bit according to claim 1, wherein each preform cutting element having a superhard front cutting face is mounted on a carrier received in a socket in the bit body.

16. A drill bit according to claim 1, wherein the surface of the bit body is provided with a plurality of blades extending outwardly with respect to the axis of rotation of the drill bit, said cutting elements being mounted along the lengths of the blades.

17. A rotary drill bit for use in drilling or coring holes in subsurface formations, comprising a bit body having a leading face and a gauge region, a plurality of cutting elements mounted at the leading face of the bit body, and a passage in the bit body communicating with openings in the leading face of the bit body for supplying drilling fluid to said face for cooling and cleaning the cutting elements, certain of said cutting elements each comprising a preform cutting element having a superhard front cutting face providing a cutting edge and others of said cutting elements each comprising particles of hard material embedded in a front layer of a less hard material to form thereon a cutting layer having a cutting edge, wherein an inner area of the leading face of the bit body around the central axis of rotation thereof and extending across substantially three quarters of the radius of the leading face of the bit body is provided substantially entirely with such embedded particle cutting elements, whereby the proportion of the combined cutting edge length provided by such embedded particle cutting elements in said inner area is 100%.

* * * * *

UNITED STATES PATENT AND TRADEMARK OFFICE

CERTIFICATE OF CORRECTION

PATENT NO. : 4,844,185

DATED : July 4, 1989

INVENTOR(S) : Thomas A. Newton, Jr. and Michael C. Regan

It is certified that error appears in the above-identified patent and that said Letters Patent is hereby corrected as shown below:

In Column 7, line 20, delete "to" and insert therefor --of--.

Signed and Sealed this

Seventeenth Day of April, 1990

*Attest:*

HARRY F. MANBECK, JR.

*Attesting Officer*

*Commissioner of Patents and Trademarks*